United States Patent [19]

Hayes

[11] Patent Number: 4,678,020

[45] Date of Patent: Jul. 7, 1987

[54] CURING FOUNDRY MOULDS AND CORES

[75] Inventor: Peter R. Hayes, Redditch, England

[73] Assignee: BCIRA, Birmingham, England

[21] Appl. No.: 809,258

[22] Filed: Dec. 16, 1985

[30] Foreign Application Priority Data

Dec. 22, 1984 [GB] United Kingdom ..... 8432571

[51] Int. Cl.[4] ..... B22C 9/12

[52] U.S. Cl. ..... 164/16; 164/525; 164/528; 106/38.2; 106/38.35

[58] Field of Search ..... 164/12, 16, 525, 528; 106/38.2, 38.35

[56] References Cited

U.S. PATENT DOCUMENTS 2,829,060 4/1958 Emblem et al. ..... 164/16

4,236,931 12/1980 Kiehl et al. ..... 106/104

4,495,980 1/1985 Morley ..... 164/16

*Primary Examiner*—Nicholas P. Godici

*Assistant Examiner*—Richard K. Seidel

*Attorney, Agent, or Firm*—Scrivener and Clarke

[57] ABSTRACT

Foundry moulds and, more especially, cores are made by the use of a binder comprising ammonium polyacrylate and zinc oxide or a metal salt to form a complex ammonium metal polyacrylate which is mixed with the sand and after the core or mould has been formed in a warm box warm air is passed through it to drive off the ammonia and form a water-insoluble metal polyacrylate which bonds the grains of sand together. The resulting core or mould has a good shelf life combined with excellent knock-out behavior.

12 Claims, 9 Drawing Figures

CURING FOUNDRY MOULDS AND CORES

This invention relates to the curing of foundry moulds and cores. Over the years many different binders have been used to hold together the refractory material, usually sand, forming foundry moulds and cores, some using single-component materials, others involving a chemical reaction between two components e.g. a resin and a setting material, or contact with a catalyst. A balance has to be struck between the conflicting requirements of low cost, simplicity of use, non-toxicity and ease of knock-out after casting.

Another important factor in most cases is shelf-life, i.e. it is important that the strength of the refractory body, and this applies particularly to cores, should not deteriorate if it is stored for an appreciable time before being put to use.

One relatively simple foundry core-making process uses a sand which is bonded with sodium silicate and cured in a heated core box by the passage of warm air through the sand mass that makes up the core. It has the merits of low cost and extreme simplicity, yielding strengths much higher than the widely used sodium silicate-carbon dioxide process but it achieves the result by dehydration of the sodium silicate binder by the warm air, and if the core is subsequently stored in conditions that are at all damp the bond re-hydrates and the core loses most of its strength.

The aim of the invention is to provide a new form of binder for binding together the particles of refractory material in foundry cores and moulds, which has the merits of simplicity in requiring to be cured only by the passage of warm air in conjunction with a warm core box, but in which the resulting core or mould retains its strength when stored for substantial periods of time and under adverse conditions but shakes out easily, especially from castings of iron or light alloys.

According to the invention there is proposed a method of making foundry moulds and cores in which a refractory material, e.g. sand, is mixed with a binder comprising ammonium polyacrylate together with a metal oxide or salt which produces a complex ammonium metal polyacrylate, and when the mould or core has been formed in a box warm air is passed through it with the box warm. The warm air has the effect of partly decomposing the complex polyacrylate to form the metal polyacrylate and to evolve ammonia.

The oxide or salt needs to be that of a metal ion which is less basic than the ammonium ion. Iron oxide is not suitable as the iron polyacrylate is weak and is soluble in water.

Because the metal polyacrylate is insoluble in water the strength of the binder, and hence of the mould or core, is not significantly affected by subsequent storage in damp conditions.

Within the terms 'polyacrylate' and 'polyacrylic acid' in the present specification and claims we include also polymethylacrylate and polymethylacrylic acid as their behaviour and reactions are closely similar.

The metal oxide is preferably zinc oxide, and so the insoluble resin formed after evolution of the ammonia is zinc polyacrylate. However chromium salts are a possible alternative, although less practical, being conveniently used in the form of sodium chromate.

Generally speaking, where zinc oxide is used, the amount of it used is critical if the strength of the mould or core is to be retained in conditions of high humidity.

We prefer that the zinc oxide should be about 0.3 percent by weight of the weight of the refractory material, although acceptable results may be obtainable with up to 1 percent.

The starting material for the ammonium polyacrylate is polyacrylic acid, which is a water-soluble resin, readily available commercially in several different grades differing in molecular weight. As will be seen later, we prefer to use one with a number average molecular weight in the lower end of the range, e.g. 76,000, and with a solids content of 25 percent, and at any rate less than 100,000, although an acid with a molecular weight of anything up to 1,000,000 may possibly be used.

An example of a binder made in accordance with the invention will now be described, together with the results of tests showing the effects of varying different parameters, and in conjunction with the accompanying drawings which illustrate some of those results, and in which.

Example 1

Figure 1:
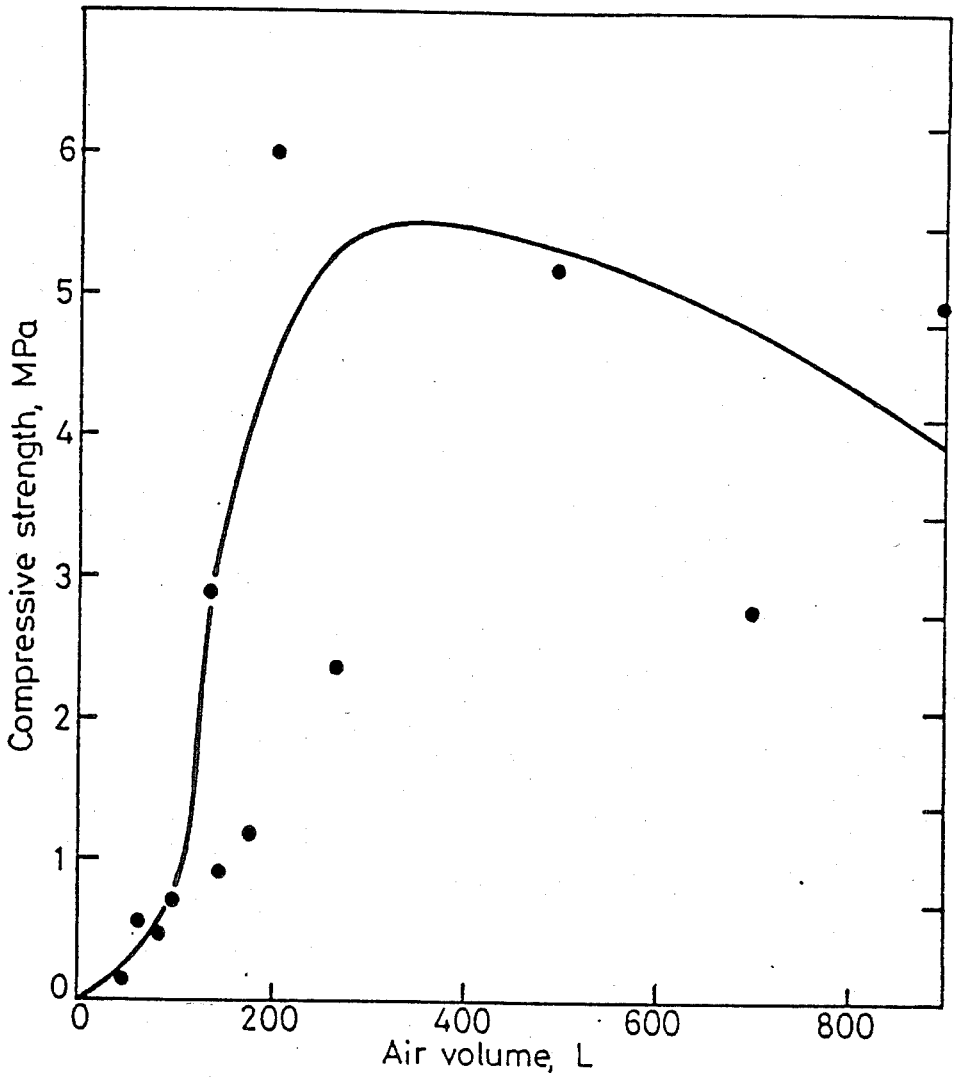
FIG. 1 is a graph showing the variation of the immediate compressive strength with increasing quantities of warm air passed through the core.

The resin part of the binder in this example was made by neutralising a aqueous solution of 25 percent polyacrylic acid of number average molecular weight 76,000 with aqueous ammonia solution of density 0.880 g $dm^{-3}$, i.e. until the pH was 7.0. Between 1.5 percent and 3.0 percent by weight (with reference to the weight of sand) of this resulting ammonium polyacrylate was added in a batch mixer to a quantity of silica foundry sand of average grain size in the range 500 to 100 microns together with between 0.13 percent and 0.6 percent by weight of zinc oxide. In the course of the process the zinc oxide and ammonium polyacrylate reacted to form ammonium zinc polyacrylate.

The resulting mixture was placed in a heated corebox at 100°–150° C. to form a shaped core and then warm air at from 100° C. to 150° C. was passed through the corebox. This partly decomposed the complex polyacrylate binder, evolving ammonia to leave a water-insoluble zinc polyacrylate binding the grains of sand together.

The following Table 1 shows the results of tests undertaken to determine the variation in the compressive strength of the resulting core when the starting material for the polyacrylate has a low and a high number average molecular weight. Two grades of polyacrylic acid were used, with a number average molecular weight in the one case of 76,000 and in the other case 230,000. Specimen cores cured with 140 liters of air and with 175 liters of air, in each case at 150° C., were tested 30 minutes after stripping, and again after 24 hours of storage in both damp and dry conditions.

TABLE 1

The figures indicate compressive strength in kiloPascals for a mixture containing 3 percent of ammonium polyacrylate and 0.3 percent of zinc oxide by weight with reference to the weight of sand.

| | Average molecular weight:- | | | |
|---|---|---|---|---|
| | 76,000 | | 230,000 | |
| | volume of warm air (liters) | | | |
| storage conditions:- | 140 | 175 | 140 | 175 |
| 30 mins at 20° C. 30 percent RH | 1310 | 340 | 850 | 590 |
| 24 hours at 20° C. 30 percent RH | 2670 | 2780 | 1415 | 1170 |
| 24 hours at 20° C. 97 percent RH | 2365 | 2450 | 1300 | 1170 |

(RH = Relative Humidity)

The above table indicates that the starting material of lower number average molecular weight (76,000) results in cores that have roughly double the compressive strength, at least after 24 hours, of those made with the starting material of higher average molecular weight. Accordingly the one of lower molecular weight was used for all subsequent work.

Table 2 illustrates the result of tests to determine the best amount of zinc oxide to add. Four different percentages by weight were added and the compressive strengths of the resulting cores were measured in kiloPascals after twenty four hours in ambient conditions (a) and under conditions of 20° C. and 82 percent relative humidity (b).

TABLE 2

Compressive strengths of mixtures containing 3.5 percent ammonium polyacrylate by weight.

| Percentage | Compressive strength (kPa) | |
|---|---|---|
| of oxide added | (a) | (b) |
| 0.13 | 6020 | 14 |
| 0.26 | 6410 | 2690 |
| 0.39 | 6120 | 3820 |
| 0.60 | 5860 | 4180 |

From this table it was determined that the optimum percentage of zinc oxide was approximately 0.3 percent and this was used in subsequent tests.

Further tests were carried out using 0.3 percent by weight of powered sodium chromate in place of the zinc oxide, and the results are shown in Table 3 in which the compressive strength is shown immediately on stripping (a) and the strength after storage for thirty minutes at 20° C. and 30 percent relative humidity (b), for different quantities of warm air at 150° C. used in the curing.

TABLE 3

| Volume of | Compressive strength (kPa) | |
|---|---|---|
| air (liters) | (a) | (b) |
| 70 | 390 | 590 |

TABLE 3-continued

| Volume of | Compressive strength (kPa) | |
|---|---|---|
| air (liters) | (a) | (b) |
| 140 | 1190 | 6880 |
| 210 | 1630 | 9770 |

The graphs which make up the Figures of the accompanying drawings mostly illustrate the results of experiments carried out to determine the rate of development of the strength of the sand-binder composition with increasing volumes of warm air, and at different temperatures. The compressive strength was determined on standard 50 mm×50 mm cylindrical test pieces compacted by three blows of a standard 6.0 kg rammer in a specimen tube which was heated to either 100° C. or 150° C. The specimens were cured by gassing with warm air at either 100° C. or 150° C. via a Ridsdale gassing cup attached to one end of the tube. Perforated discs were inserted in both ends of the tube to hold the specimen in place against the significant displacement forces engendered by the high rates of air flow used.

In the making of these specimens, all of which contained 3 percent by weight of ammonium polyacrylate and mostly contained 0.3 percent by weight of zinc oxide (apart from those which contained sodium chromate instead) the initial weight of sand mixture was determined accurately and the specimens were weighed again after curing and stripping from the tube in order to determine any weight loss attributable to the removal of water and volatile components.

A similar method was usd to make specimens of dog-bone shape for use in determining the tensile strength.

The rates of development of the strength with increasing volume of air used for curing were determined using curing times, i.e. durations of time of the air flow, from one to ten minutes, and flow rates between 50 and 90 liters a minute, representing total quantities of air from 50 to 900 liters.

Figure 2:
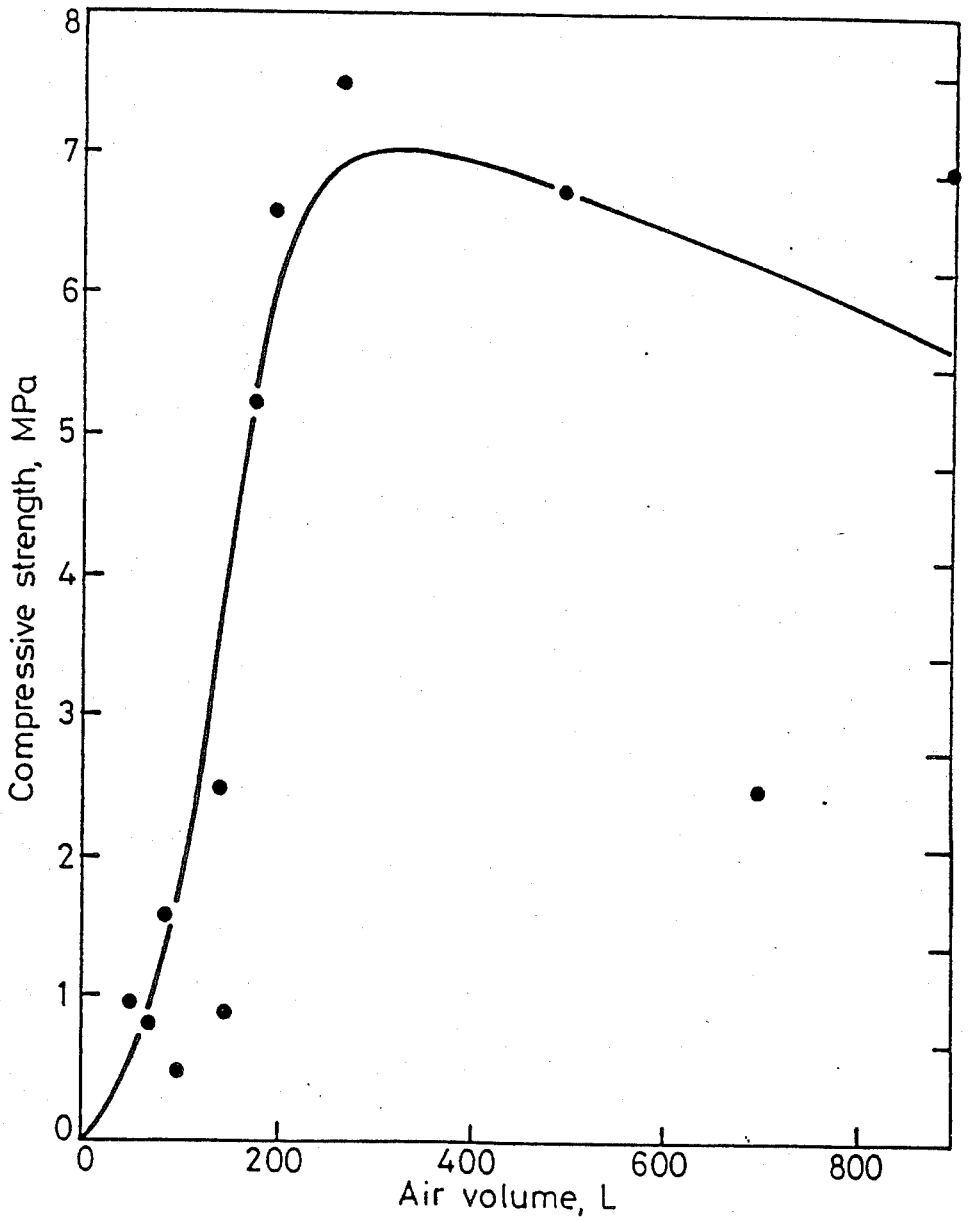
FIG. 2 is a graph showing the variation in the compressive strength exhibited by the core thirty minutes after curing with increasing quantities of warm air.

Referring to FIG. 1, the compressive strength, immediately after stripping from the tube, of a core cured with air at 100° C. in a corebox which was itself kept at 100° C. was found to rise to a maximum of about 5 MPa when the total quantity of air used was around 200 to 300 liters. The strengths of the same specimens were measured again after 30 minutes and the results are shown in FIG. 2, which indicates that they could reach over 7 MPa as they cooled to room temperature.

Figure 3:
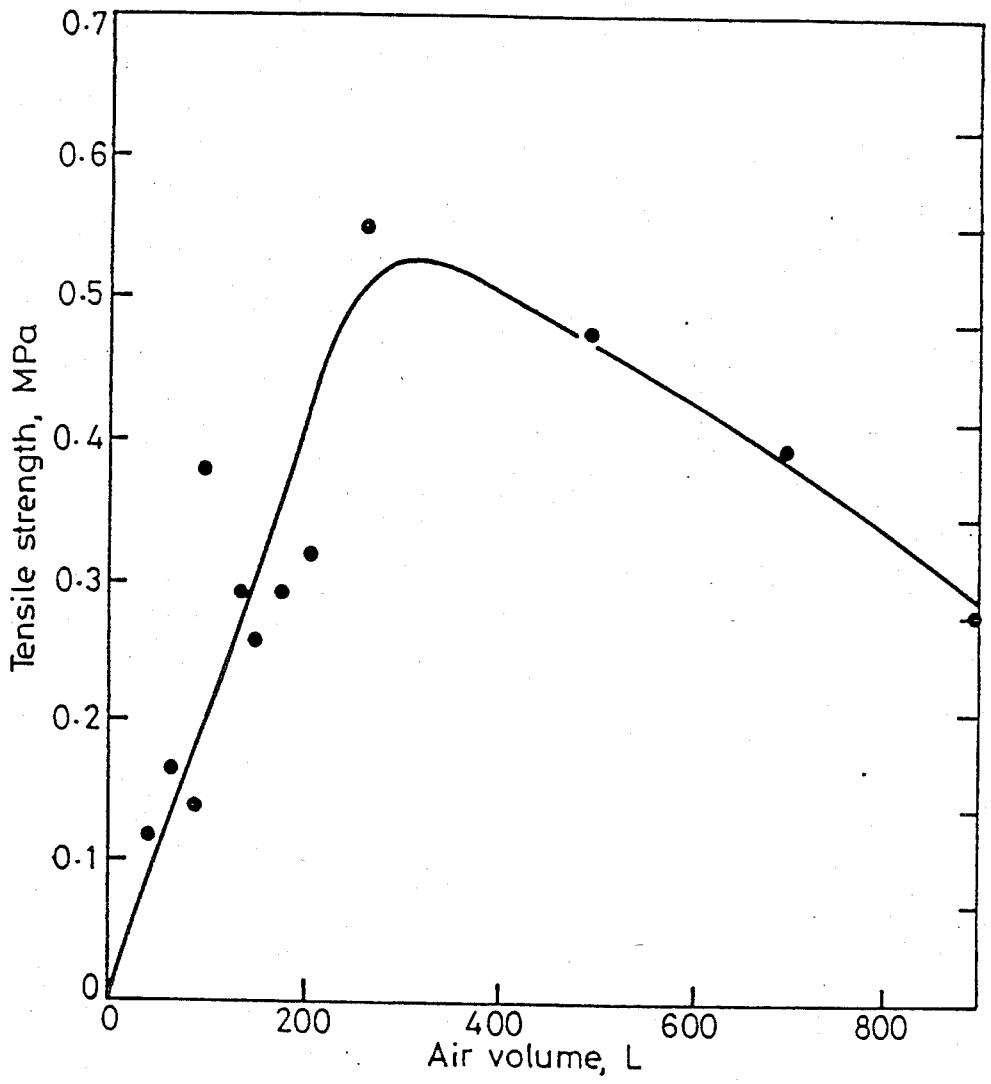
FIG. 3 is a graph showing the variation in the immediate tensile strength with increasing quantities of warm air.
Figure 4:
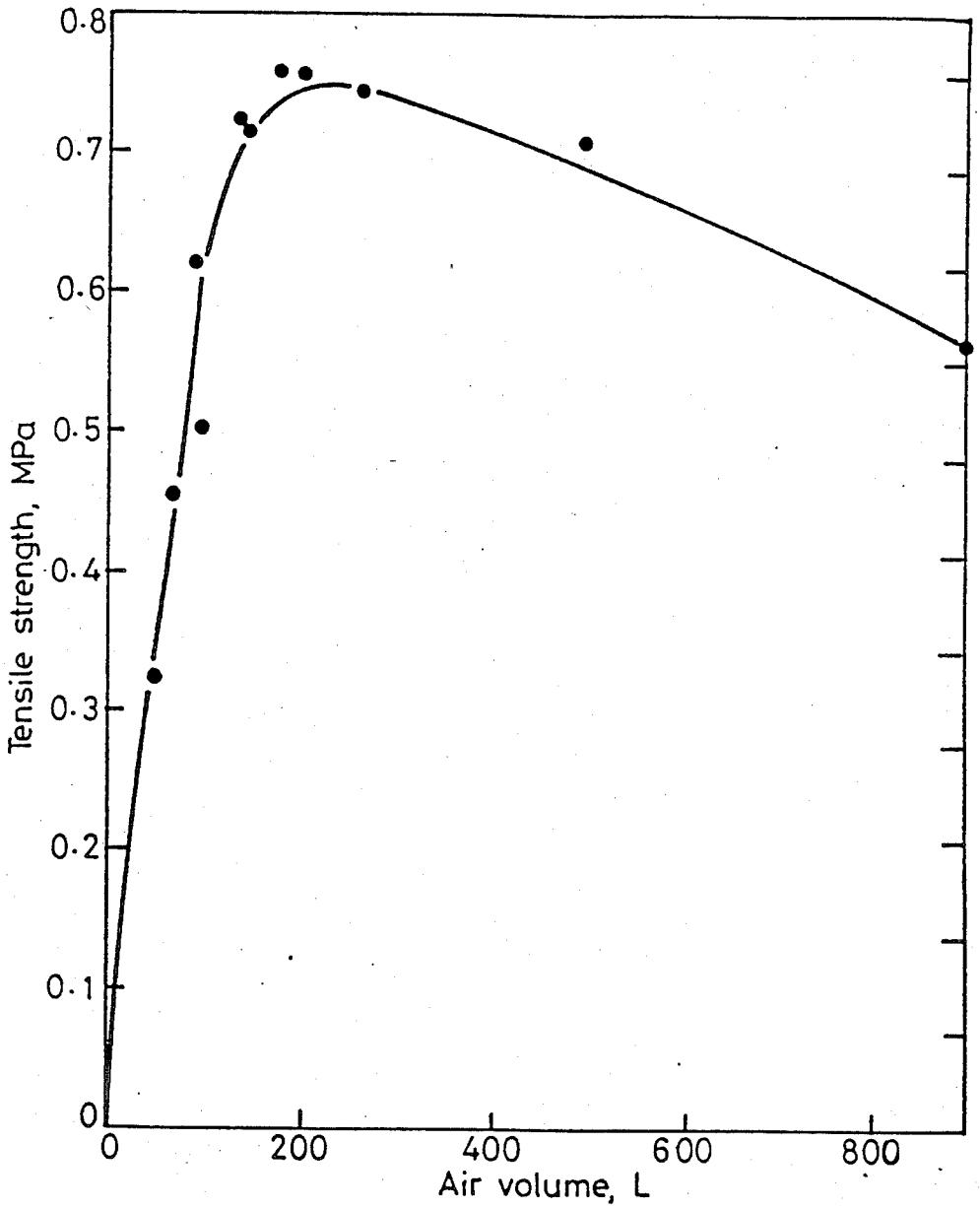
FIG. 4 is a graph showing the variation in the tensile strength exhibited thirty minutes after curing with increasing quantities of warm air.

FIG. 3 shows similar results when the tensile strength was measured (using dog-bone specimens) immediately after stripping. It will be seen that this reached a little over 0.5 MPa when the quantity of warm air used (again at 100° C., with the box also at 100° C.) was between 200 and 300 liters. FIG. 4, which shows the result of the same test 30 minutes after stripping, shows a rise in maximum tensile strength to about 0.75 MPa.

Further tests, the results of which are not shown separately, indicated that when the temperature of both the warm air and of the tube or corebox was raised to 150° C. the compressive and tensile strengths were very similar to the results above.

In these experiments the amount of air used to cure the cores was varied both by varying the rate of flow and by varying the duration of the flow. When cores are being made in a foundry under practical conditions the duration and the flow rate would be varied to pass the required total quantity of air through the core in a time acceptable for the required rate of production, bearing in mind the size of the core.

Figure 5:
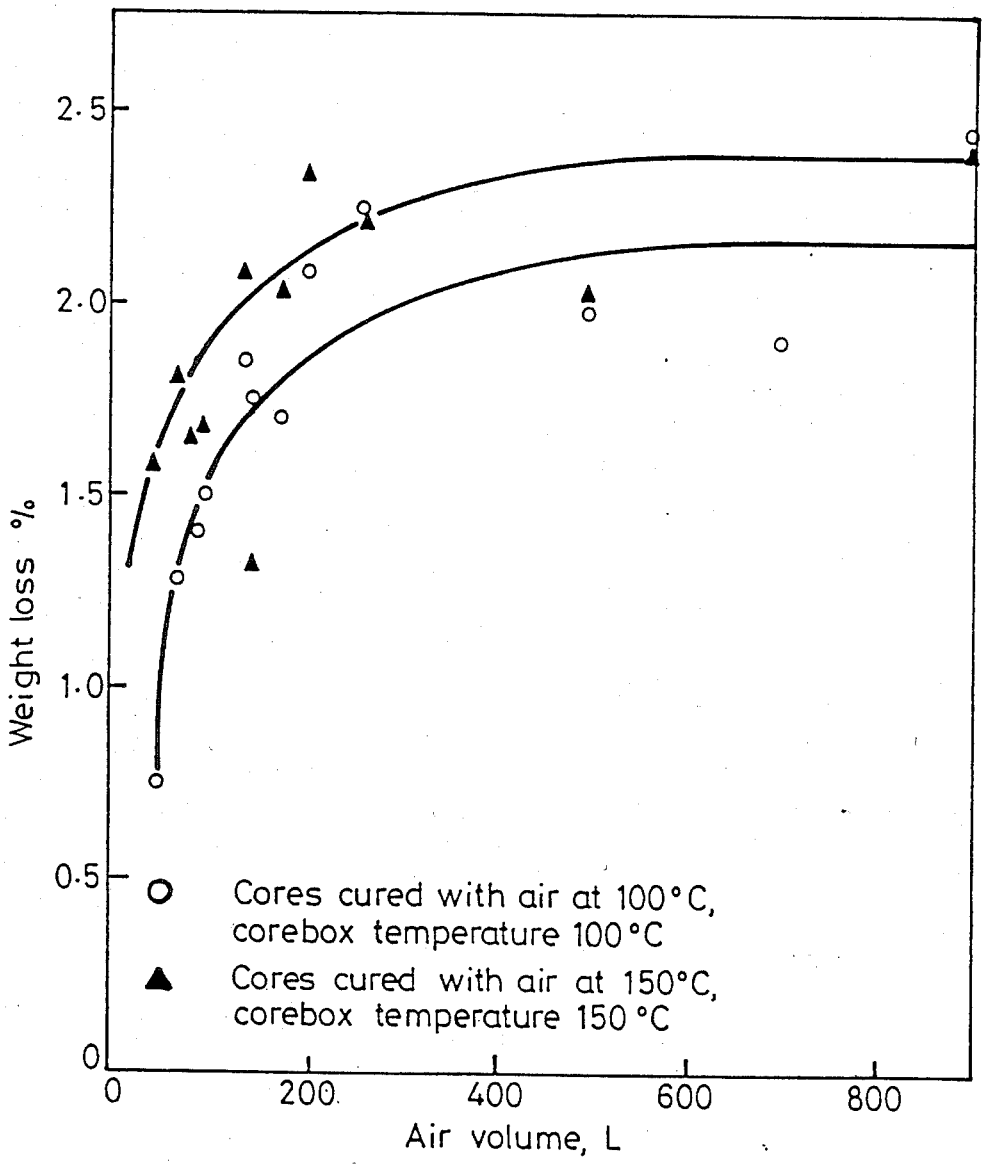
FIG. 5 shows the rate of loss of weight of the core with increasing quantities of warm air, illustrating the variation when the temperature of the air and the corebox is changed.

The ammounium zinc polyacrylate binder is water-based, and the effect of the warm air is to drive off most of the water. The graph forming the subject of FIG. 5 shows the percentage weight loss which this represents, and indicates that most of this water was evaporated rapidly, i.e. within the first 100 or 200 liters of air flow, and equally rapidly with the air and the box at 100° C. and with them at 150° C., although not surprisingly in the latter case the weight loss was greater.

Figure 6:
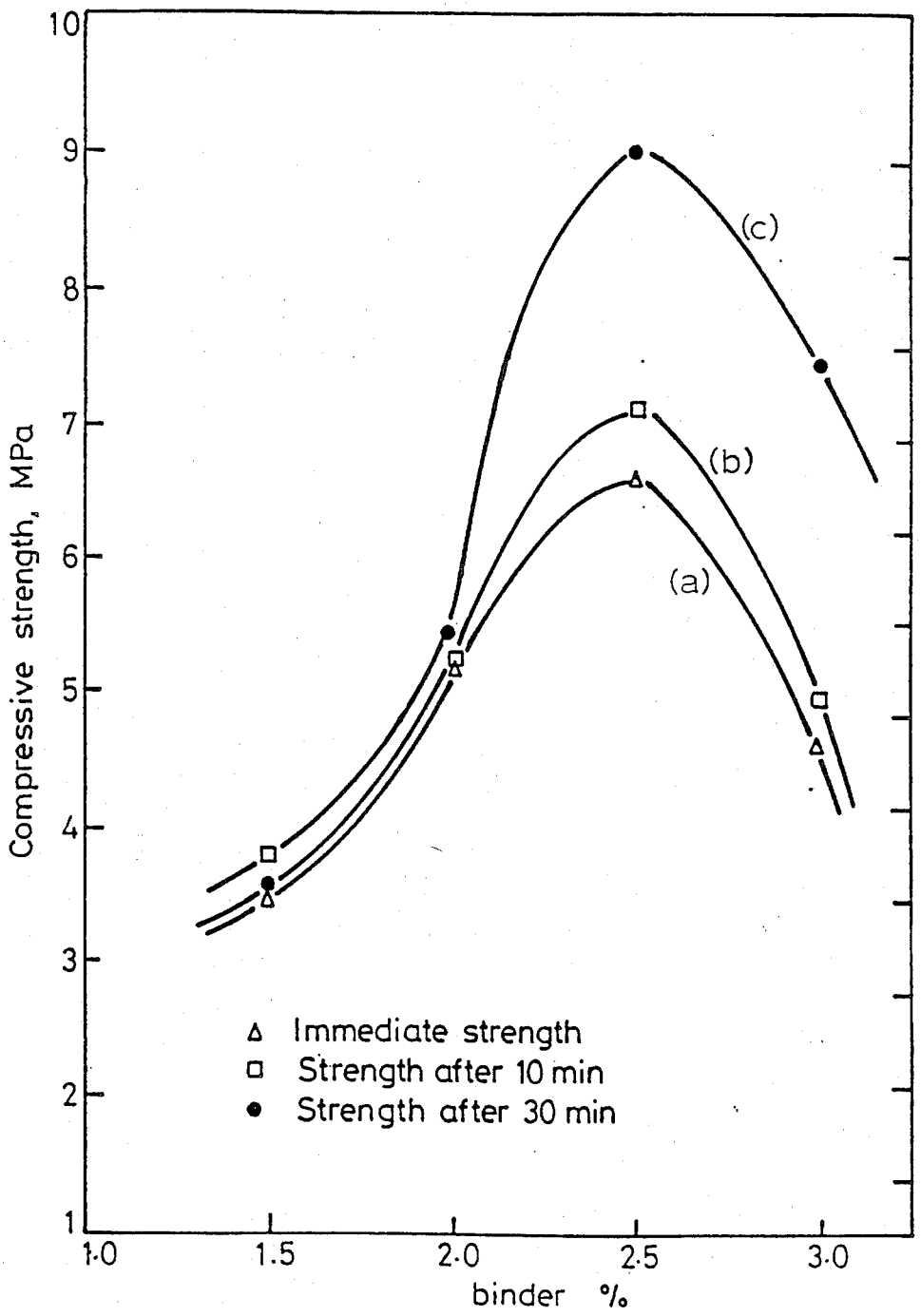
FIG. 6 is a graph showing the variation in compressive strength of the core with changes in the percentage of binder in the mixture.

To determine the effect of different amounts of the binder in the total mixture, experiments were carried out with different percentages (by weight) of the binder between 1.5 and 3 percent. The results are shown in FIG. 6 and it will be seen that the compressive strength reached a marked peak at a binder content of about 2.5 percent, although it was acceptable at between 2 percent and 3 percent. The three curves show respectively the strength immediately after stripping (a), the strength after ten minutes (b), and the strength after 30 minutes (c).

Figure 7:
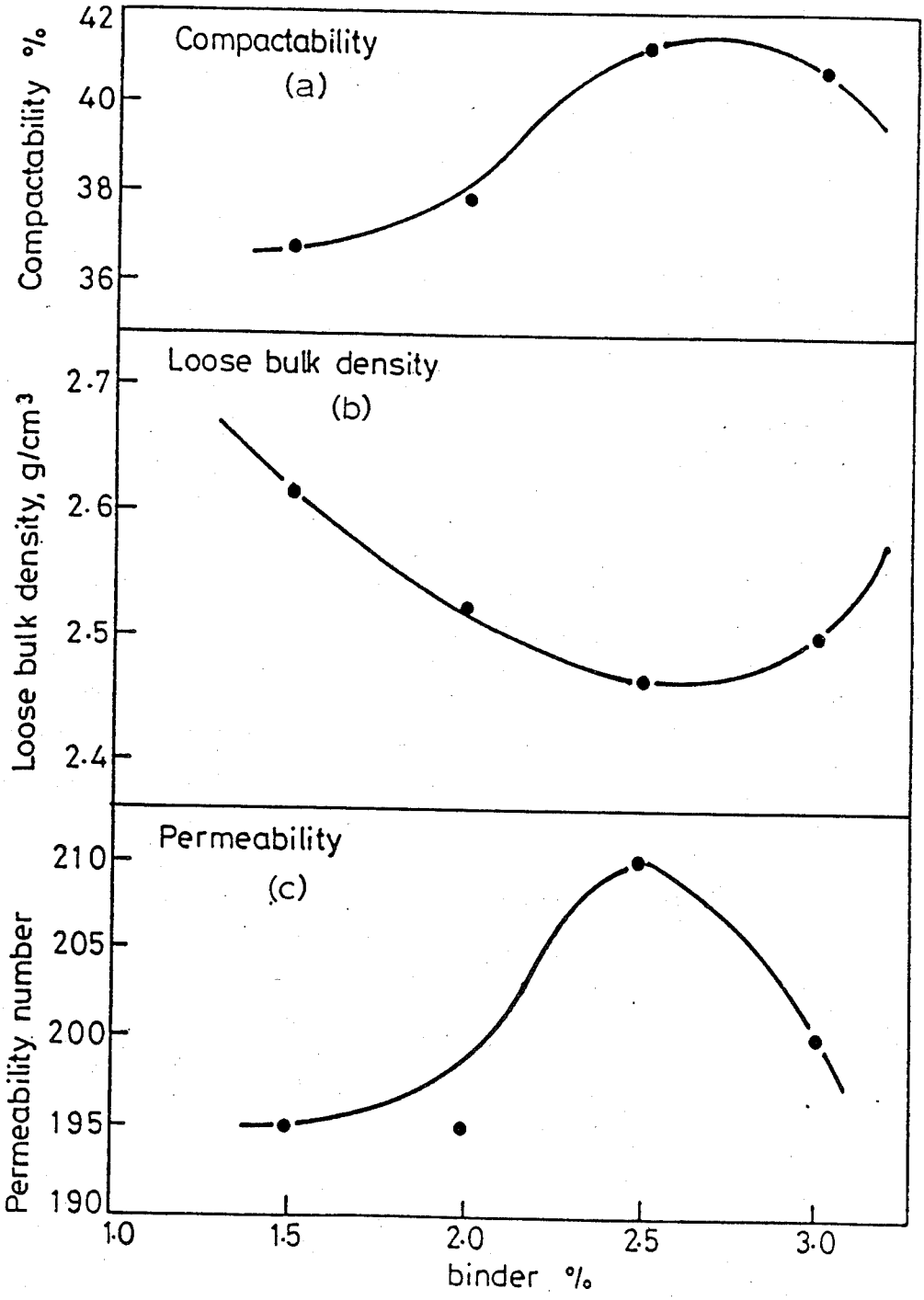
FIG. 7 illustrates the variation of other factors with changes in the percentage of binder in the mixture.

FIG. 7 shows the results of measurements of other factors in relation to different binder contents, again covering 1.5 to 3.0 percent. These factors are compactability (a), loose bulk density (b), and permeability number (c). The graphs make it clear that these are at an optimum at a binder content of 2.5 percent or a little above.

Figure 8:
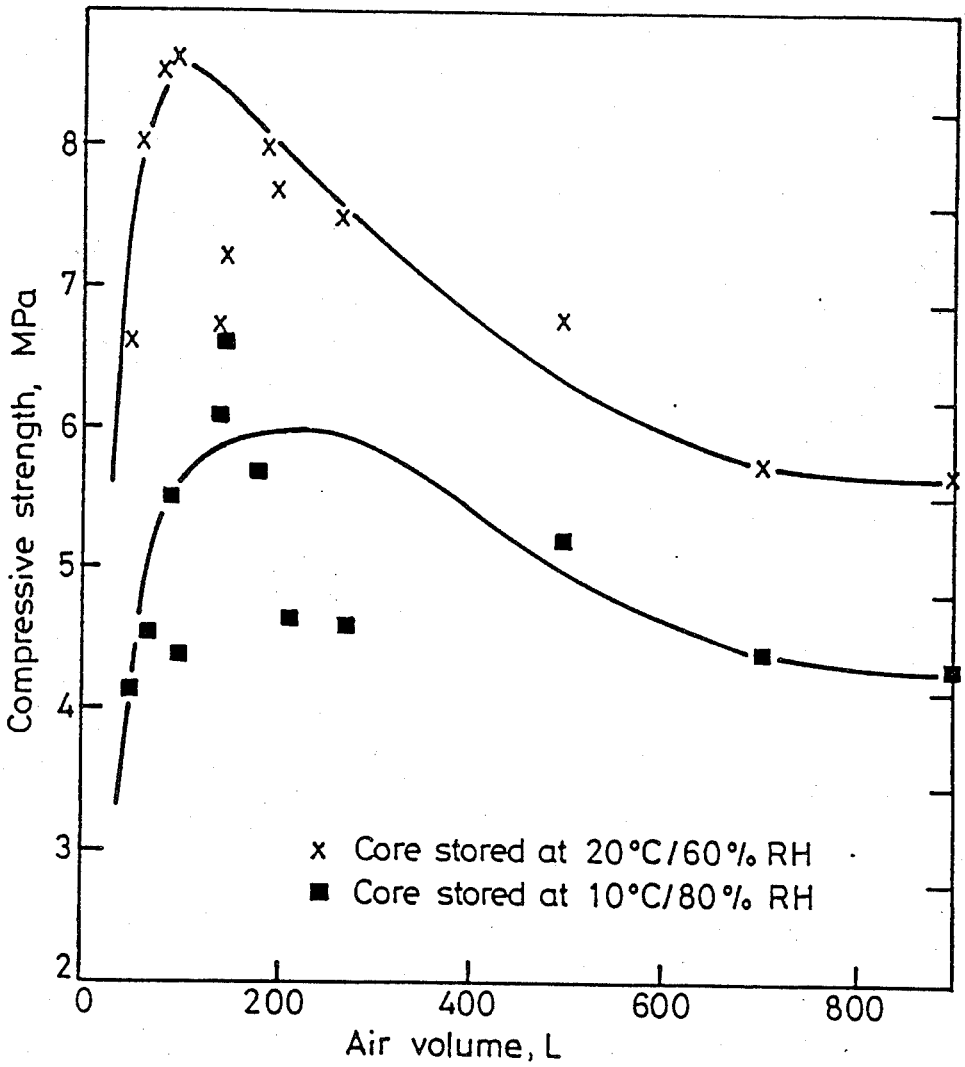
FIG. 8 is a graph showing the variation in compressive strength with the quantity of warm air used, for different conditions of storage; and, finally.

Good shelf life and the ability to retain strength in cold, damp conditions are important requirements for any core binder. The compressive strengths of cores according to the invention were tested after exposure in an environmental chamber maintained at 10° C. and 80 percent relative humidity and their strengths compared with similar cores stored in a warmer, drier climate at 20° C. and 60 percent relative humidity. This comparison was applied to a range of cores which had been cured with varying volumes of warm air at 100° C. in coreboxes kept at 100° C. and then stored for 24 hours in the environmental chamber under the conditions stated. The result is shown in FIG. 8, the lower curve being that for those stored in the humid conditions at 10° C. and the upper curve those stored at 20° C. in a drier atmosphere. It will be seen that in the drier atmosphere the cores, after 24 hours had high strengths of the order of 8 or 9 MPa and even those stored in humid conditions had compressive strengths in the range 4 to 6 MPa.

These results applied, as stated, to cores cured at 100° C. Similar results were obtained for cores cured at 150° C.

Figure 9:
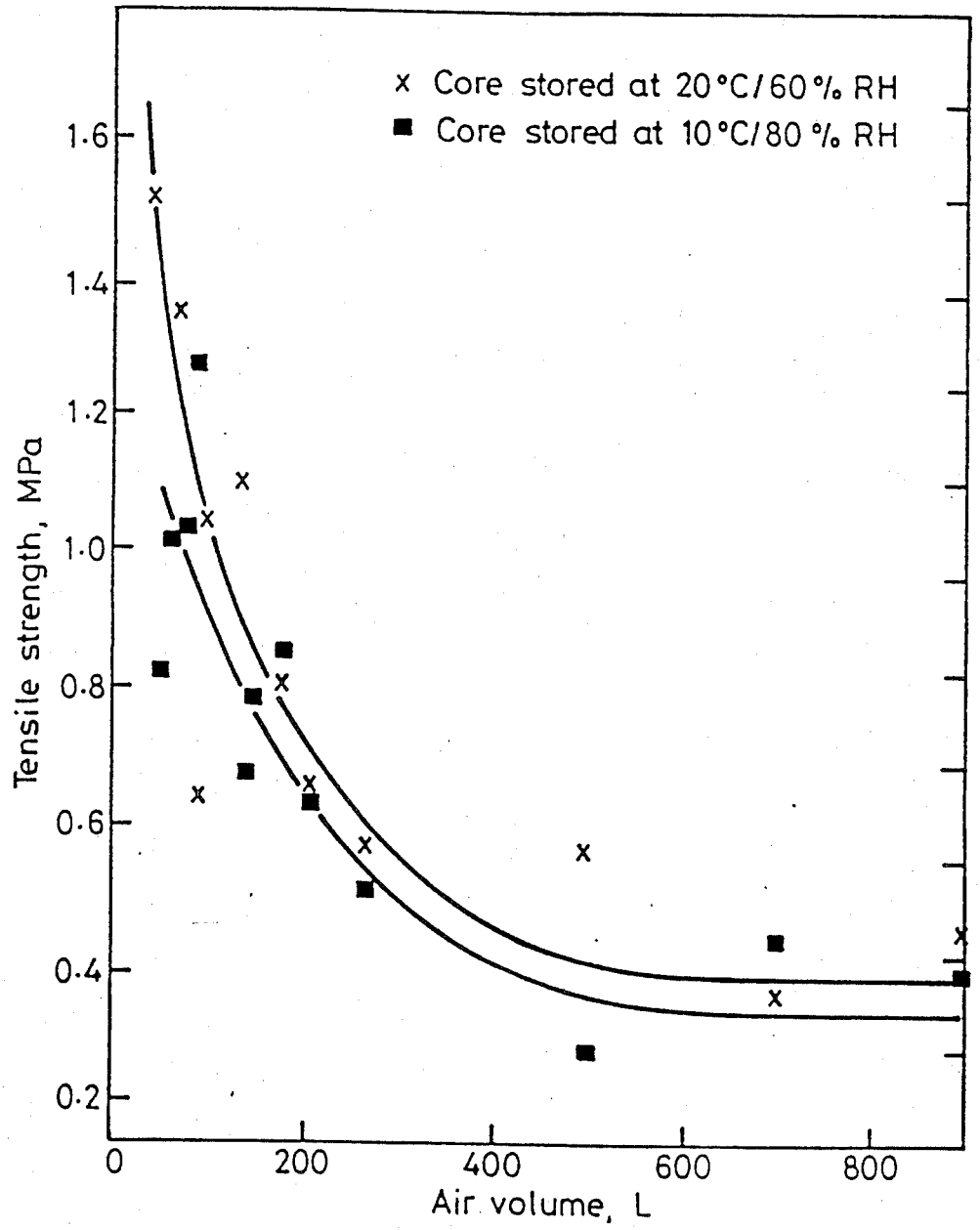
FIG. 9 shows the variation in tensile strength with increasing quantities of warm air used, for different conditions of storage.

FIG. 9 shows the results of tests carried out on the same range of cores as FIG. 8, except that the strength measured was the tensile, not the compressive strength. Again, the upper curve is for the cores stored at the higher temperature and drier conditions and the lower curve for those stored at 10° C. and 80 percent relative humidity. It will be seen that there was little difference between the two.

Comparisons were also made between the cores made according to the invention and cores made by other methods, to see their relative ease of shake-out. The other cores were those made respectively by the sodium silicate—carbon dioxide process, by the sodium silicate—warm air process, and by a process using a urea formaldehyde furan resin catalysed with phosphoric acid. Six samples were compared altogether, with the following binders.

1. 3.3 percent ammonium zinc polyacrylate.
2. 3.0 percent sodium silicate (2:1 ratio, 1.56 specific gravity,) hardened with the carbon dioxide.
3. 3.5 percent sodium silicate otherwise as above.
4. 3.5 percent sodium silicate (2:1 ratio, 1.56 specific gravity) hardened with air at 105° C.
5. 3.5 percent sodium silicate as above, but hardened with air at 150° C.
6. 1.5 percent UF/FA resin catalysed with 50 percent (by weight of resin) of phosphoric acid.

Small 50 mm×50 mm cylindrical cores weighing 0.16 kg were tested in sets of six in 25 kg grey iron castings poured at 1400° C.

The casting were cooled to room temperature with all the cores intact and a BCIRA-Ridsdale impact probe was used to measure the retained strengths of the cores. The following Table 4 shows the average number of impacts required to penetrate 10 mm increments through the cores to a depth of 50 mm:

TABLE 4

| Core number | Number of impacts |
|---|---|
| 1 | 0.0 |
| 2 | 12.9 |
| 3 | 20.3 |
| 4 | 31.8 |
| 5 | 33.3 |
| 6 | 0.3 |

The very good shake-out properties of the cores according to the invention (core No. 1) were confirmed using 1.8 kg stepped pyramid cores in grey iron castings. When they were cold the castings were subjected to repeated hammer blows until all the cores were removed. Cores made with the binder according to the invention were completely shaken out after only two impacts, whereas after forty impacts only 13 percent of a core made by the silicate—carbon dioxide process had been removed. The following Table 5 shows the results (the core numbers are the same as in the previous table)

TABLE 5

| Core number | Number of impacts |
|---|---|
| 1 | 2 |
| 2 | more than 40 |
| 6 | 11 |

There was no sign of finning in castings made with the cores according to the invention. The larger 1.8 kg pyramid cores were used uncoated and subsequently slight sand burn-on and penetration was apparent on the surface of the castings. The best surface finish, with minimum burn-on and penetration, was achieved with the core made in accordance with the invention and the other two binders gave inferior surfaces.

I claim:

1. A method of making foundry moulds and cores, said method comprising mixing a granular refractory material with a binder comprising ammonium polyacrylate together with a metal compound which produces a complex ammonium metal polyacrylate to produce a refractory mixture, forming a mould or core from said mixture in a warm box, and passing warm air through said mixture to convert said ammonium metal polyacrylate into a waterinsoluble metal polyacrylate with the evolution of ammonia, said binder being present to the extent of up to 5 percent by weight of the weight of said refractory material.

2. The method set forth in claim 1 wherein said metal compound is zinc oxide, said insoluble polyacrylate formed therefore being zinc polyacrylate.

3. The method set forth in claim 1 wherein said metal compound is sodium chromate.

4. The method set forth in claim 1 wherein the air and said box are at temperature not exceeding 200° C.

5. The method set forth in claim 4 wherein the air and said box are at a temperature of between 100° and 150° C.

6. The method set forth in claim 1 wherein said binder is present to the extent of between 1.5 and 3 percent by weight of the weight of said refractory material.

7. The method set forth in claim 6 wherein said binder is present to the extent of substantially 2.5 percent by weight of the weight of said refractory material.

8. The method set forth in claim 1 wherein said ammonium polyacrylate is formed by neutralising polyacrylic acid of number average molecular weight not more than 1,000,000.

9. The method set forth in claim 8 wherein the number average molecular weight of said polyacrylic acid is not more than 100,000.

10. A method of making foundry moulds and cores, said method comprising mixing a granular refractory material with a binder comprising ammonium polyacrylate together with a metal compound which produces a complex ammonium metal polyacrylate to produce a refractory mixture, forming a mould or core from said mixture in a warm box, and passing warm air through said mixture to convert said ammonium metal polyacrylate into a waterinsoluble metal polyacrylate with the evolution of ammonia, said metal compound being present to the extent of not more than 1 percent by weight of the weight of said refractory material.

11. The method set forth in claim 10 wherein said metal compound is present to the extent of between 0.2 and 0.6 percent by weight of the weight of said refractory material.

12. The method set forth in claim 11 wherein said metal compound is present to the extent of substantially 0.3 percent by weight of the weight of said refractory material.

* * * * *